US009895571B2

(12) United States Patent
Wang

(10) Patent No.: US 9,895,571 B2
(45) Date of Patent: Feb. 20, 2018

(54) ADJUSTABLE EXERCISE DEVICE

(71) Applicant: Beto Engineering & Marketing Co., Ltd., Taichung (TW)

(72) Inventor: Lo Pin Wang, Taichung (TW)

(73) Assignee: Beto Engineering & Marketing Co., Ltd., Beitun, Taichung (TW)

( * ) Notice: Subject to any disclaimer, the term of this patent is extended or adjusted under 35 U.S.C. 154(b) by 0 days.

(21) Appl. No.: 15/373,498

(22) Filed: Dec. 9, 2016

(65) Prior Publication Data

US 2017/0239510 A1 Aug. 24, 2017

Related U.S. Application Data

(63) Continuation of application No. 15/049,173, filed on Feb. 22, 2016.

(51) Int. Cl.

| | |
|---|---|
| ***A63B 21/072*** | (2006.01) |
| ***A63B 21/075*** | (2006.01) |
| ***A63B 21/00*** | (2006.01) |
| ***A63B 71/06*** | (2006.01) |

(52) U.S. Cl.

CPC ..... *A63B 21/075* (2013.01); *A63B 21/00065* (2013.01); *A63B 21/0724* (2013.01); *A63B 21/0726* (2013.01); *A63B 21/0728* (2013.01); *A63B 21/4035* (2015.10); *A63B 71/0619* (2013.01); *A63B 2071/0658* (2013.01); *A63B 2220/62* (2013.01)

(58) Field of Classification Search

CPC . A63B 21/075; A63B 21/072; A63B 21/0722; A63B 21/0724; A63B 21/0726; A63B 21/0728

See application file for complete search history.

(56) References Cited

U.S. PATENT DOCUMENTS

| | | | |
|---|---|---|---|
| 5,518,478 | A | 5/1996 | Liang |
| 5,839,997 | A | 11/1998 | Roth et al. |
| 6,416,446 | B1 | 7/2002 | Krull |
| 6,656,093 | B2 | 12/2003 | Chen |
| 6,669,606 | B2 | 12/2003 | Krull |
| 6,719,674 | B2 | 4/2004 | Krull |
| 6,733,424 | B2 | 5/2004 | Krull |
| 7,137,931 | B2 | 11/2006 | Liu |
| 7,153,243 | B1 | 12/2006 | Krull |
| 7,172,536 | B2 | 2/2007 | Liu |
| 7,223,214 | B2 | 5/2007 | Chen |
| 7,485,077 | B2 | 2/2009 | Chen |
| 7,731,641 | B1 | 6/2010 | Chen |
| 8,025,613 | B1 | 9/2011 | Wang |

(Continued)

*Primary Examiner* — Nyca T Nguyen

(74) *Attorney, Agent, or Firm* — Charles E. Baxley

(57) ABSTRACT

An adjustable barbell or dumbbell or exercise device includes a handle device having a handle bar engageable into grooves of a number of weight members, a number of plates disposed on the handle bar and engageable between the weight members, and the plates each include an engaging element for engaging with the weight members and for anchoring a selected number of weight members to the handle bar, and a detecting device is attached to the handle device and includes a weight detector connected to a processing unit for sending weighing signals to the processing unit, and a displayer for displaying a total weight of the handle device and the weight members.

8 Claims, 17 Drawing Sheets

(56) References Cited

U.S. PATENT DOCUMENTS

| | | | | |
|---|---|---|---|---|
| 2003/0199368 | A1* | 10/2003 | Krull | A63B 21/075<br>482/106 |
| 2009/0186748 | A1* | 7/2009 | Golesh | A63B 21/0728<br>482/107 |
| 2009/0305852 | A1* | 12/2009 | Hoglund | A63B 21/0728<br>482/107 |
| 2013/0288859 | A1* | 10/2013 | Watterson | A63B 24/0062<br>482/8 |
| 2015/0360073 | A1* | 12/2015 | Moran | A63B 21/075<br>482/107 |
| 2015/0367163 | A1* | 12/2015 | Moran | A63B 21/075<br>482/108 |
| 2016/0089575 | A1* | 3/2016 | Smith | H04M 1/72533<br>482/5 |
| 2016/0184623 | A1* | 6/2016 | Moran | A63B 21/075<br>482/8 |
| 2017/0001061 | A1* | 1/2017 | Marjama | A63B 71/0036 |

* cited by examiner

ADJUSTABLE EXERCISE DEVICE

The present invention is a continuation-in-part of U.S. patent application Ser. No. 15/049,173, filed 22 Feb. 2016, pending.

BACKGROUND OF THE INVENTION

1. Field of the Invention

The present invention relates to an adjustable exercise device or dumbbell or barbell or the like, and more particularly to an adjustable exercise device or dumbbell including an improved compact structure for allowing the weight members to be easily and quickly and readily and adjustably attached to or disengaged from the weight carrier or handle and for allowing the adjustable dumbbell to be easily operated by the user.

2. Description of the Prior Art

Typical exercise devices or barbells or dumbbells comprise a central handle member to be grasped or held by the user, and a number of weight plates to be attached onto the ends of the handle member for weight lifting or exercising purposes, or for exercising or training the upper muscle groups or the lower muscle groups of the user.

For example, U.S. Pat. No. 5,518,478 to Liang, U.S. Pat. No. 5,839,997 to Roth et al., U.S. Pat. No. 6,416,446 to Krull, U.S. Pat. No. 6,656,093 to Chen, U.S. Pat. No. 6,669,606 to Krull, U.S. Pat. No. 6,719,674 to Krull, U.S. Pat. No. 6,733,424 to Krull, U.S. Pat. No. 7,137,931 to Liu, U.S. Pat. No. 7,153,243 to Krull, U.S. Pat. No. 7,172,536 to Liu, U.S. Pat. No. 7,223,214 to Chen, U.S. Pat. No. 7,485,077 to Chen, U.S. Pat. No. 7,731,641 to Chen, and U.S. Pat. No. 8,025,613 to Wang disclose several typical adjustable dumbbells each comprising a number of weight plates or weight members selectively or adjustably attaching or mounting onto the handle shaft or handle bar that is provided for being held or grasped by the users to train the upper muscle groups or the lower muscle groups of the user, and a latch device attached onto the handle and/or the weighted plates for selectively or adjustably mounting or securing selected or different number of the weighted plates on the ends of the handle and for exercising or training the upper muscle groups or the lower muscle groups of the user.

A supporting base is further required to be provided for stably supporting the weight plates or weight members in place, and the latch device is required to be moved relative to the handle or the weight plates or weight members or actuated to engage with the required or selected number of the weighted plates or weight members when the weight plates or weight members are supported on or in the supporting base, and before the handle and the weight plates or weight members may be lifted or moved away from the supporting base, and the latch device is required to be moved relative to the handle or the weight plates or weight members or actuated to engage with and to couple the required or selected number of the weighted plates or weight members to the handle before the handle and the weight plates or weight members may be lifted or moved away from the supporting base.

However, the typical adjustable dumbbells include a complicated structure or configuration that may not be easily and quickly made or manufactured by the manufacturers and that may include a complicated making or manufacturing procedure and that may include a greatly increased manufacturing cost.

The present invention has arisen to mitigate and/or obviate the afore-described disadvantages of the conventional adjustable dumbbells.

SUMMARY OF THE INVENTION

The primary objective of the present invention is to provide an adjustable exercise device or barbell or dumbbell including an improved compact structure for allowing the weight members to be easily and quickly and readily and adjustably attached to or disengaged from the weight carrier or handle and for allowing the adjustable dumbbell to be easily operated by the users.

The other objective of the present invention is to provide an adjustable exercise device or barbell or dumbbell including an improved compact structure for allowing the adjustable exercise device or dumbbell to be made or manufactured by the manufacturers.

In accordance with one aspect of the invention, there is provided an adjustable exercise device comprising a number of weight members each including a groove formed therein, and the weight members each including a tongue extended laterally therefrom, a handle device including a handle bar having an end portion selectively engageable into the grooves of the weight members, and a hand grip disposed on the handle bar, a number of plates rotatably disposed on the handle bar and rotated in concert with the hand grip relative to the handle bar, the plates being selectively engageable between the weight members, and the plates each including an engaging element provided thereon for selectively engaging with the tongues of the weight members respectively when the plates and the hand grip are rotated relative to the handle bar, and for selectively anchoring a selected number of weight members to the handle bar of the handle device with the plates and for allowing the user to adjust the adjustable exercise device to different weight or the like, and a detecting device may further be attached to the handle device and includes a central processing unit, a weight detector electrically connected to the central processing unit for sending the detected weight signals to the central processing unit, and a displayer electrically connected to the central processing unit for sending signals to the central processing unit and for displaying a total weight of the handle device and the weight members, and/or for displaying the calories consumed by the user and calculated with the central processing unit.

The detecting device includes a timer electrically connected to the central processing unit for sensing and sending a timing signal to the central processing unit. The detecting device includes a transmitting unit electrically connected to the central processing unit for receiving and/or sending signals from and to the central processing unit.

The detecting device includes a switch electrically connected to the central processing unit for being actuated or switched and for sending the switching signals to the central processing unit. A first of the plates includes a number of protrusions extended therefrom for selectively engaging with the switch and for actuating the switch.

The handle device includes a shank for engaging into the grooves of the weight members and for anchoring the housing to the weight members and for preventing the housing from rotating relative to the weight members, and the shank includes a chamber formed therein for receiving or engaging with the detecting device. The shank includes an aperture formed therein and communicating with the chamber of the shank for receiving or engaging with the switch.

The handle device includes a follower disposed between the plates and the hand grip and rotated in concert with the plates and the hand grip relative to the handle bar, the follower includes a number of flaps extended therefrom and spaced from each other for forming a number of notches between the flaps, the shank includes a window formed in the shank, and the follower includes a number of ears for selectively aligning with the window of the shank, and the ears each include a numeral for being shown through the window of the shank.

The handle device includes a housing rotatably engaged on the handle bar, and the housing includes a spring biased latch for selectively engaging with either of the notches of the follower and for preventing the follower from being rotated relative to the housing, and the housing includes a casing having a compartment formed in the casing for slidably receiving or engaging with the spring biased latch.

The housing includes a spring biased projection engageable with the follower for anchoring and positioning the follower to the housing at selected angular positions, and the follower includes a number of depressions formed therein for selectively engaging with the spring biased projection and for solidly and stably anchoring the follower to the housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
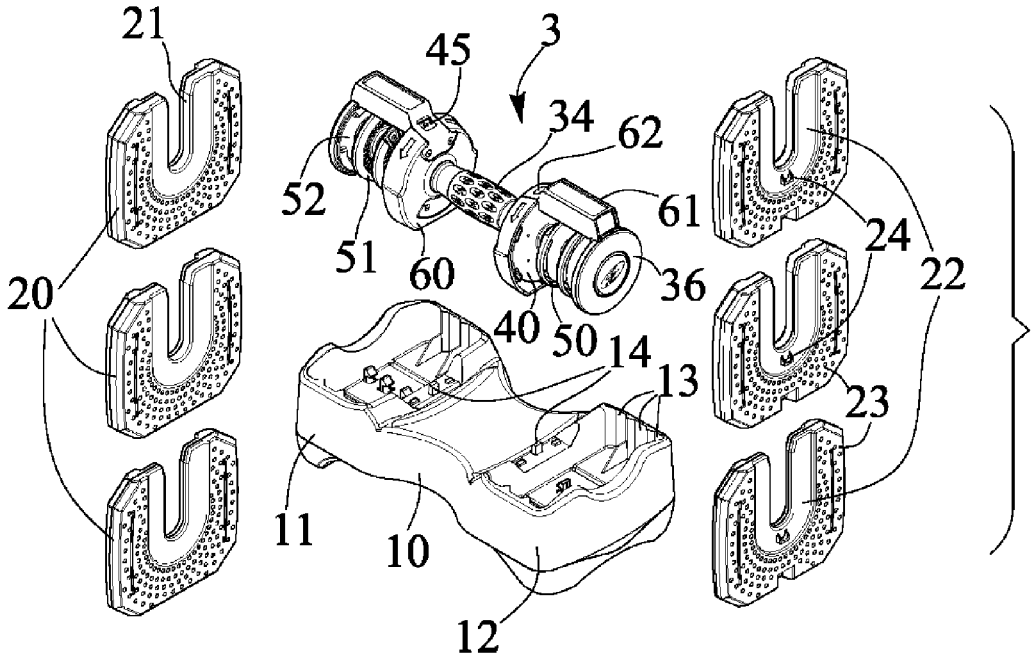
FIG. 1 is a partial exploded view of an adjustable exercise device or barbell or dumbbell in accordance with the present invention.

Referring to the drawings, and initially to FIGS. 1-6, an adjustable dumbbell or barbell or exercise device in accordance with the present invention comprises a receptacle or base support 10 including one or more (such as two) side or end portions 11, 12 each having one or more (such as three) recesses or socket openings 13 formed therein for receiving or accommodating or engaging with the weight plates or weight members 20 respectively, and each having a projection or key 14 extended upwardly therefrom. The weight members 20 each include a U-shaped opening or groove 21 formed therein, and each include a depression or recess 22 formed in either or both of the side portions 23 thereof and communicating with the groove 21 of the respective weight member 20, and the weight members 20 each further include a key or tongue 24 extended laterally and outwardly therefrom, such as extended into the recess 22 thereof and in line with or located below the groove 21 of the respective weight member 20.

Figure 3:
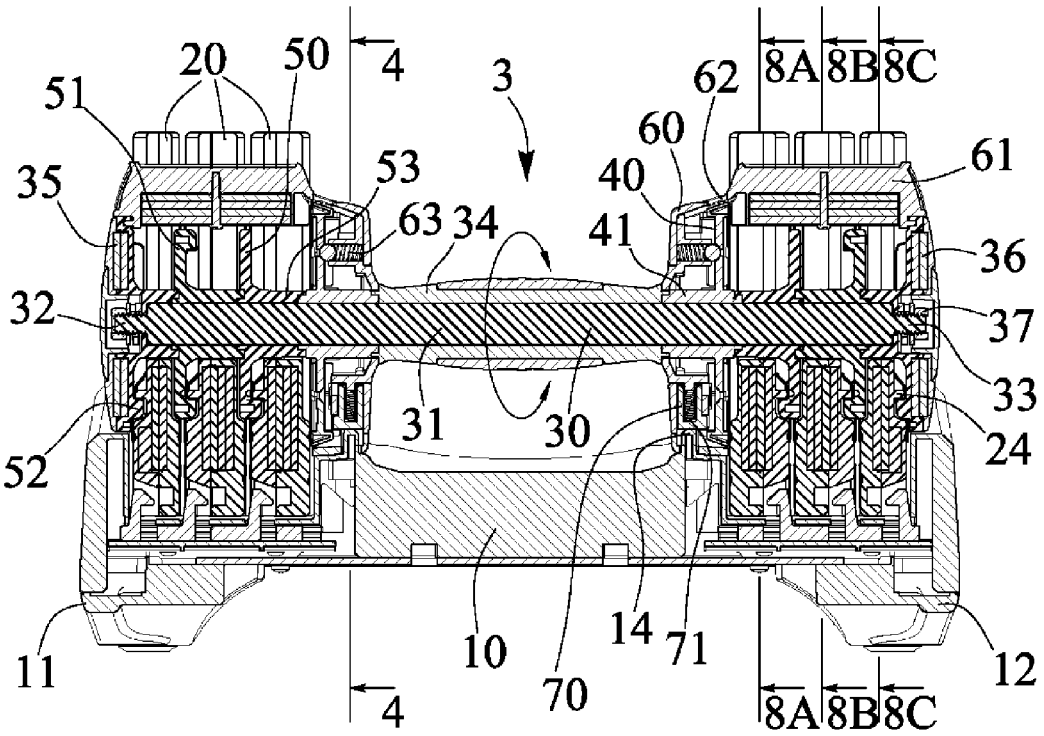
FIG. 3 is a cross sectional view of the adjustable dumbbell, taken along lines 3-3 of FIG. 2.
Figure 5:
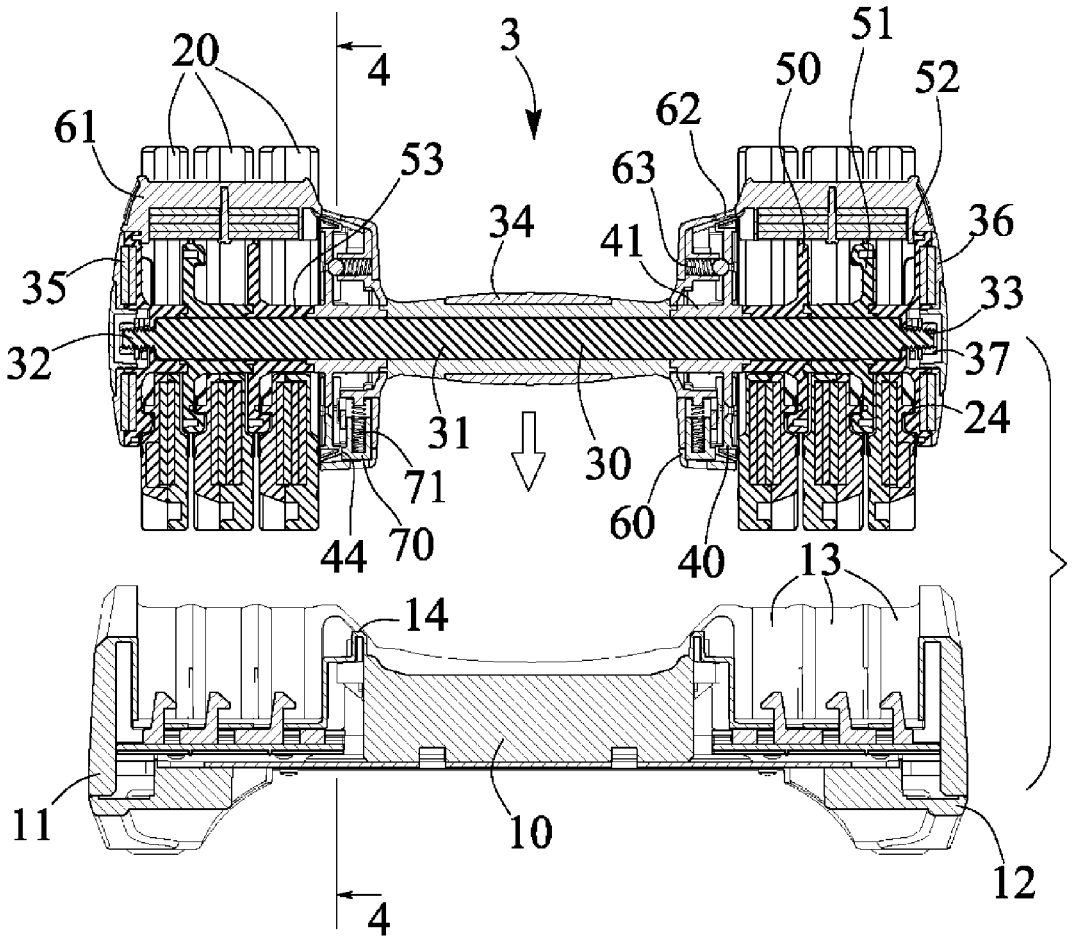
FIG. 5 is a further cross sectional view of the adjustable dumbbell, in which the handle and the weight members are removed or separated from the base support.
Figure 7:
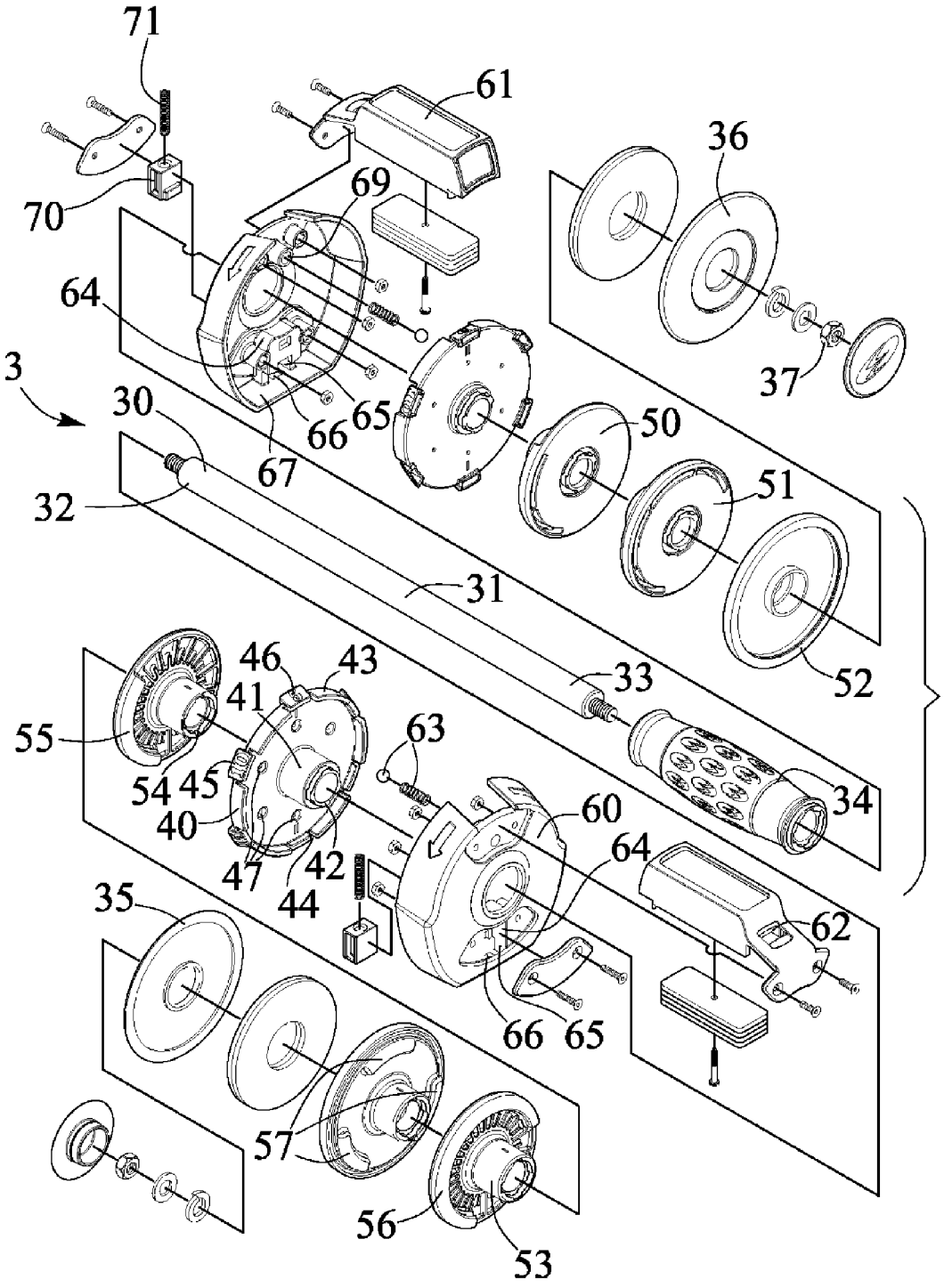
FIG. 7 is another partial exploded view of the adjustable dumbbell.

The adjustable exercise device or dumbbell further comprises a handle device 3 including a longitudinal spindle or handle bar 30 having a middle or intermediate portion 31 and two end portions 32, 33, best shown in FIGS. 3, 5, 7, and a hand grip 34 rotatably disposed or provided on the middle or intermediate portion 31 of the handle bar 30 for being grasped or held by the user and for carrying or lifting or moving the handle device 3 and for allowing the adjustable dumbbell to be easily operated by the user. The hand grip 34 is rotatable relative to the handle bar 30 (FIG. 3). One or more (such as two) end plates or end members 35, 36 are attached or mounted or secured to the end portions 32, 33 of the handle bar 30 respectively, for example, the end members 35, 36 are solidly and stably mounted or secured to the end portions 32, 33 of the handle bar 30 with latches or fasteners 37 respectively for allowing the end members 35, 36 to be pivoted or rotated in concert with the handle bar 30.

One or more (such as two) followers 40 are rotatably disposed or provided on the end portions 32, 33 of the handle bar 30 and mounted or secured to the hand grip 34 and pivoted or rotated in concert with the hand grip 34 relative to the handle bar 30, for example, the followers 40 each include a cylindrical member or drum 41 formed or provided on the middle or center portion thereof and rotatably engaged on the handle bar 30 and extended toward the hand grip 34 and engaged with or secured to the hand grip 34 with a toothed or serrated mechanism 42 (FIG. 7) for allowing the followers 40 to be pivoted or rotated in concert with the hand grip 34 relative to the handle bar 30. The followers 40 each include one or more (such as six), or a number of flaps 43 laterally extended from the outer peripheral portion thereof and equally spaced from each other and extended toward the hand grip 34 for forming or defining one or more (such as six), or a number of equally spaced gaps or notches 44 between the flaps 43.

As also shown in FIG. 7, the followers 40 each further include one or more (such as six), or a number of equally spaced ears 45 formed or provided or extended in the notches 44 of the followers 40 respectively, and the ears 45 each include a mark or digital or numeral 46 formed or provided thereon for weight indicating purposes. The followers 40 each further include one or more (such as six), or a number of equally spaced recesses or depressions 47 formed in one side portion thereof and faced or directed toward the hand grip 34. One or more (such as three) spacing panels or plates 50, 51, 52 are also rotatably disposed or provided on the end portions 32, 33 of the handle bar 30 and disposed between the followers 40 and the end members 35, 36 respectively, and the plates 50, 51, 52 each include a cylindrical member or barrel 53 formed or provided on the middle or center portion thereof and rotatably engaged on the handle bar 30 and extended toward the other plates 50, 51 or the followers 40 for separating or spacing the plates 50, 51, 52 and the followers 40 from each other.

Figure 13:
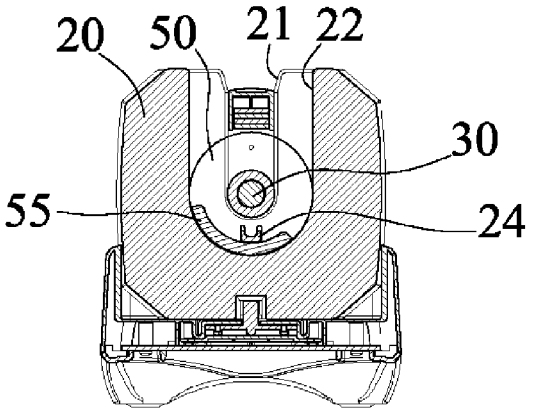
FIGS. 13, 14, and 15 are still further cross sectional views similar to FIGS. 8A, 8B, 8C; 9A, 9B, 9C; 10A, 10B, 10C; 11A, 11B, 11C; and 12A, 12B, 12C respectively, illustrating the operation of the adjustable dumbbell as shown in FIG. 5.
Figure 14:
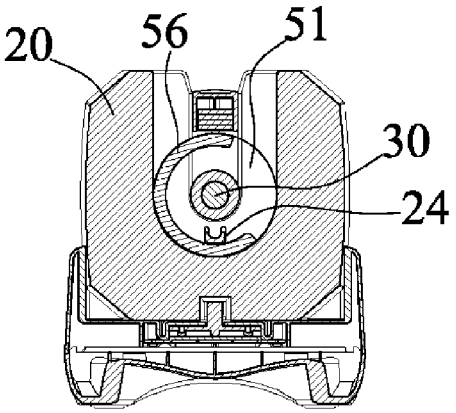
Figure 15:
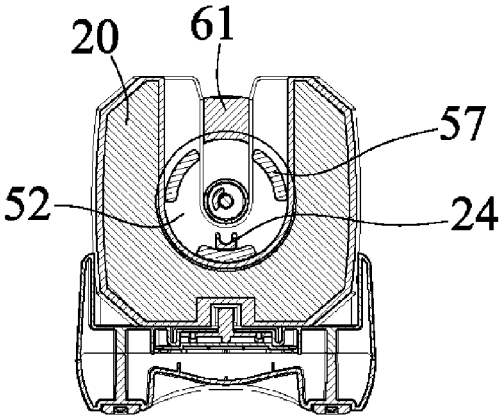
Figure 16:
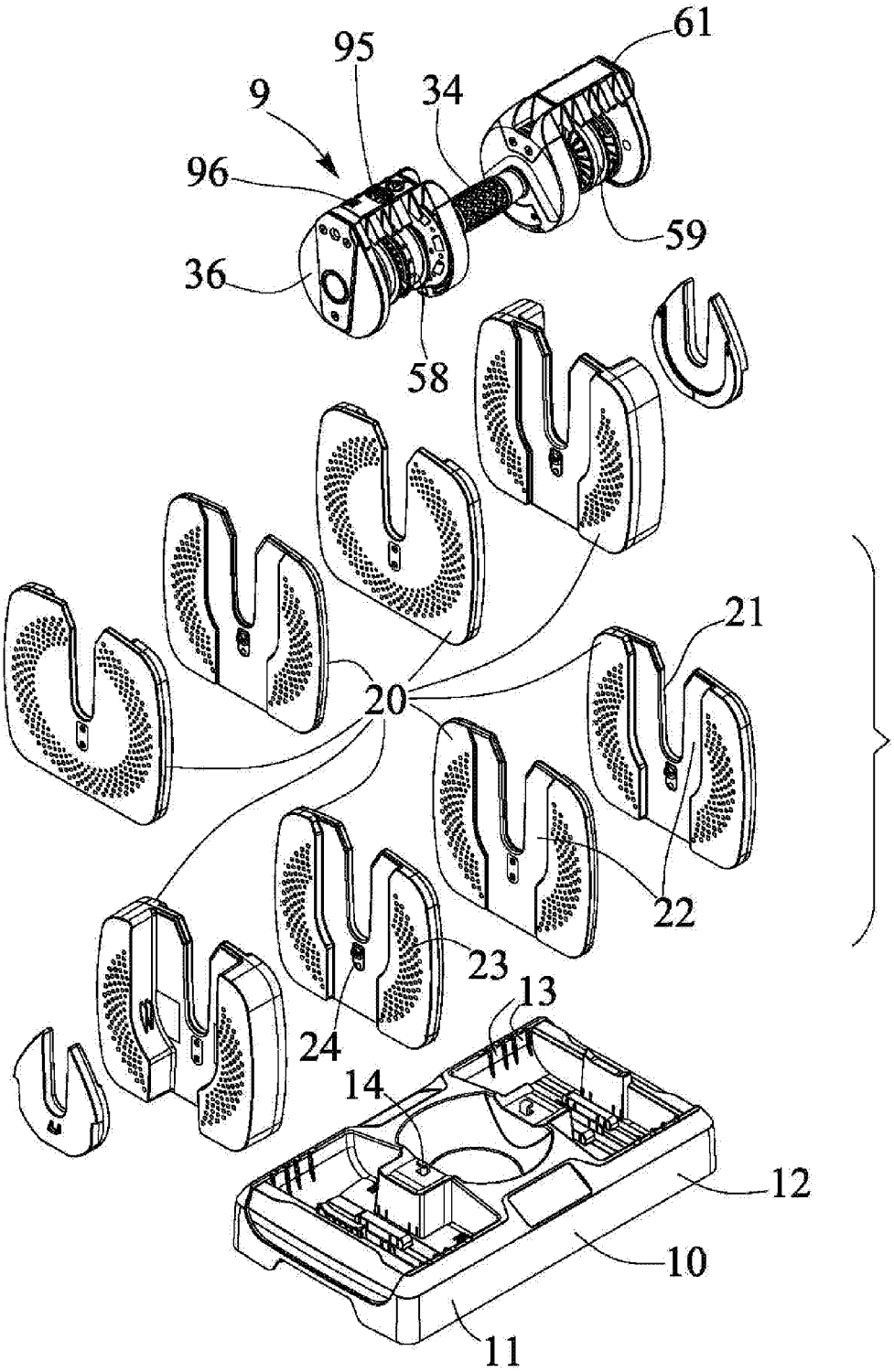
FIG. 16 is a further partial exploded view of the adjustable dumbbell.
Figure 17:
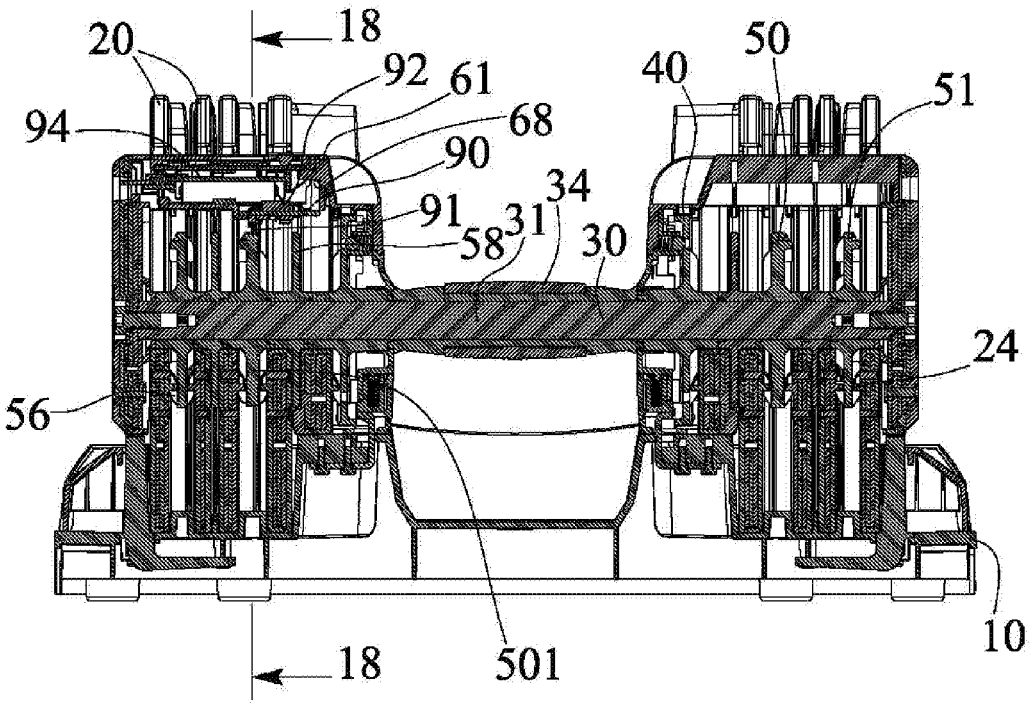
FIG. 17 is a further cross sectional view of the adjustable dumbbell, taken along lines 17-17 of FIG. 18.

For example, the first plate 50 is disposed and arranged or located closer to the follower 40, and the second plate 51 is disposed and arranged or located between the first and the third plates 50, 52, and the third plate 52 is disposed and arranged or located closer to the end member 35, 36 respectively, the barrels 53 of the second and the third plates 51, 52 are extended toward the first and the second plates 50, 51 respectively, and the barrels 53 of the first and the second plates 50, 51 are extended toward the follower 40 and the first plate 50 respectively, and the barrels 53 of the plates 50-52 are engaged with or secured to the other plates 50, 51 and the follower 40 with a toothed or serrated mechanism 54 (FIG. 7) for allowing the plates 50-52 and the followers 40 to be pivoted or rotated in concert with the hand grip 34 relative to the handle bar 30. The plates 50, 51, 52 each include one or more engaging or anchoring members or elements 55, 56, 57 formed or provided on the outer peripheral portion of the plates 50-52 respectively, for selectively engaging with the tongues 24 of the weight members 20 (FIGS. 13-15).

Figure 8A:
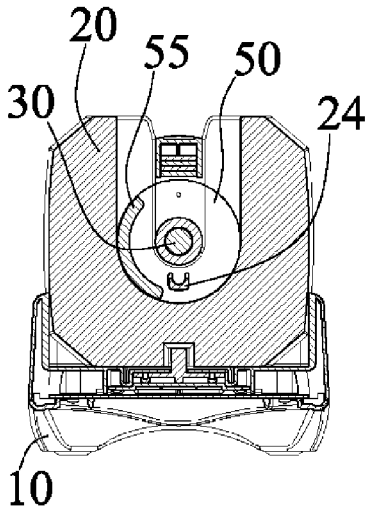
FIGS. 8A, 8B, 8C are still further cross sectional views of the adjustable dumbbell, taken along lines 8A-8A, 8B-8B, 8C-8C of FIG. 3 respectively.
Figure 8B:
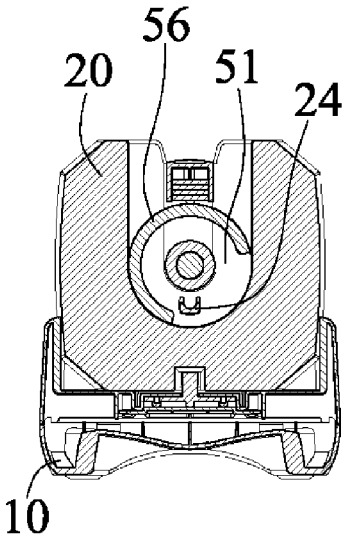
Figure 8C:
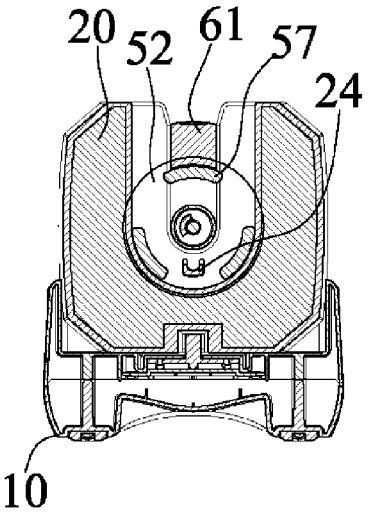
Figure 8:
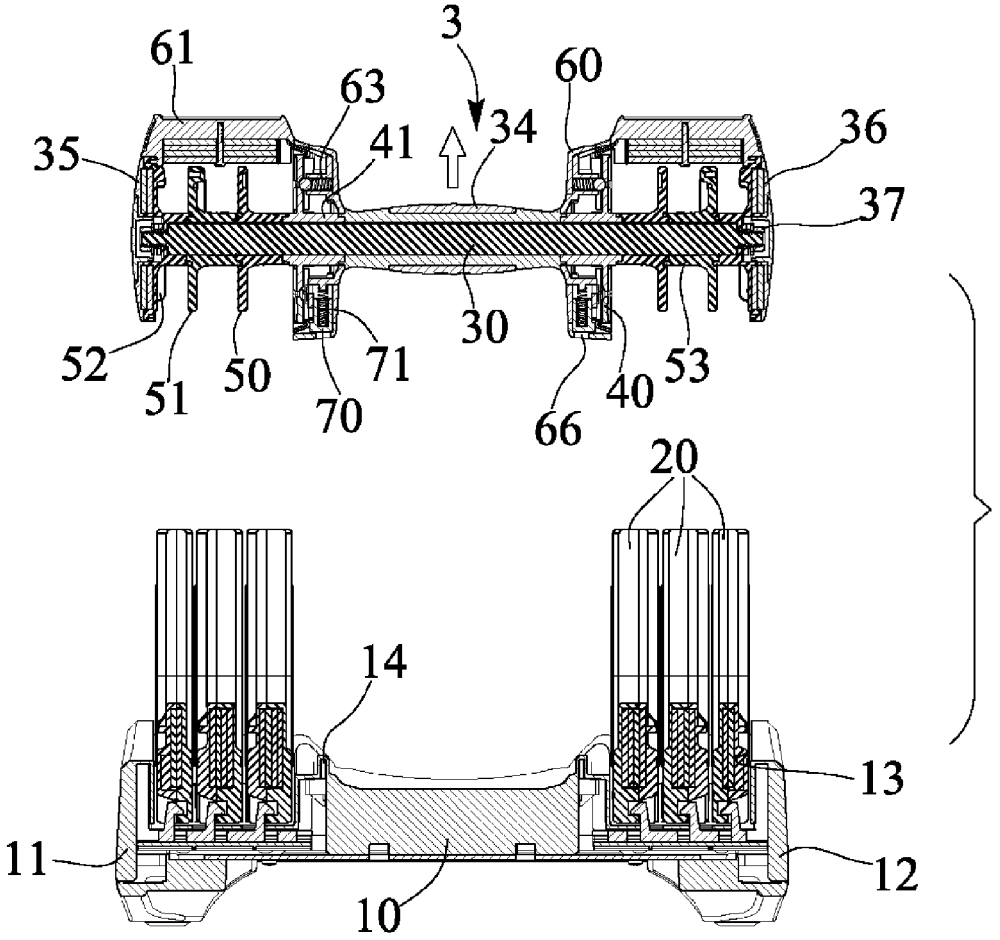
FIGS. 8, 9, 10, 11, 12 are still further cross sectional views similar to FIG. 5, illustrating the operation of the adjustable dumbbell.
Figure 9A:
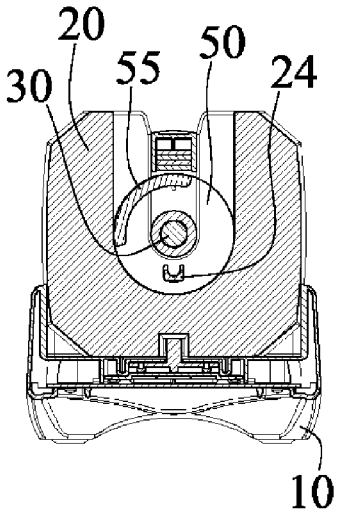
FIGS. 9A, 9B, 9C; 10A, 10B, 10C; 11A, 11B, 11C; and 12A, 12B, 12C are still further cross sectional views similar to FIGS. 8A, 8B, 8C respectively, illustrating the operation of the adjustable dumbbell as shown in FIGS. 9, 10, 11, 12 respectively.
Figure 9B:
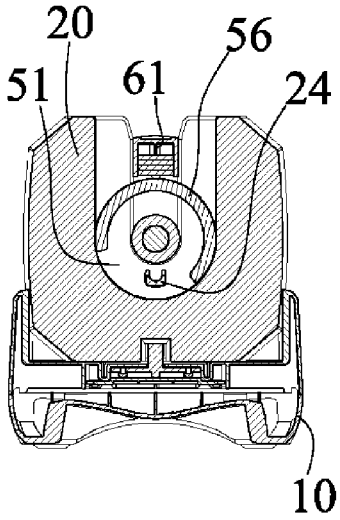
Figure 9C:
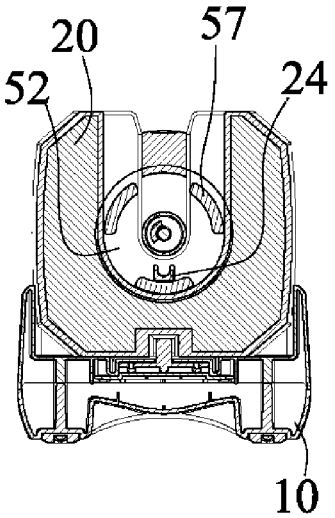
Figure 9:
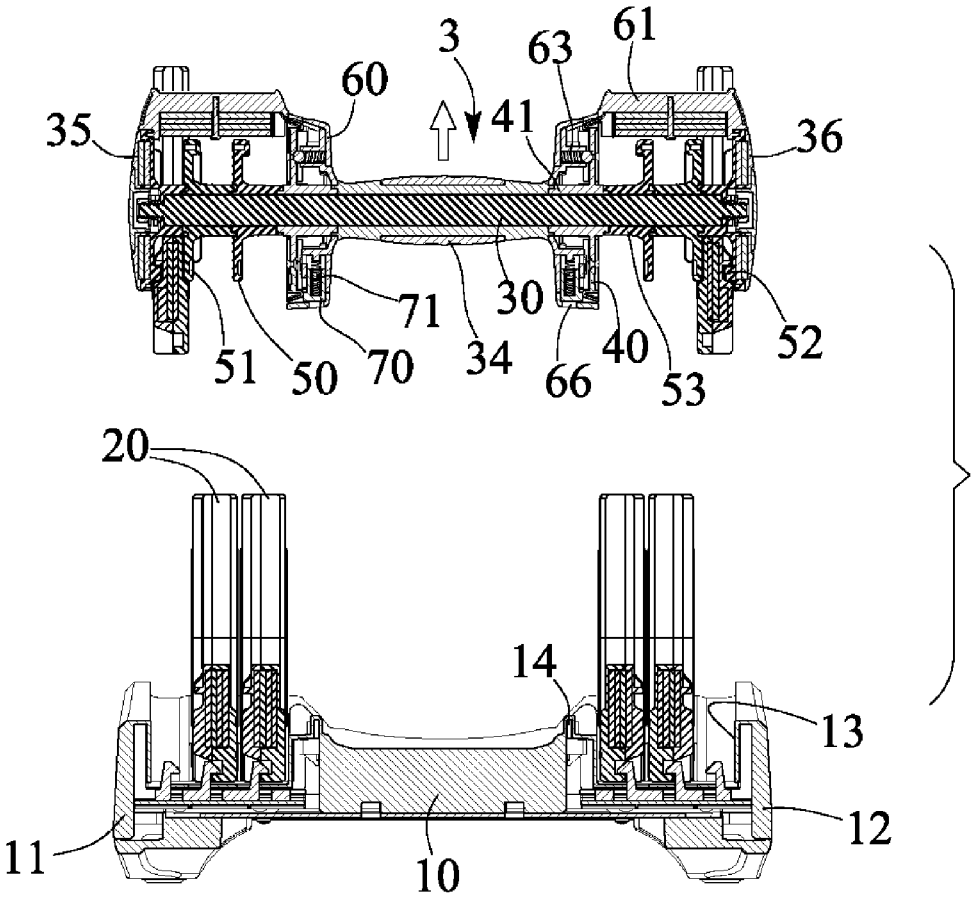
Figure 10A:
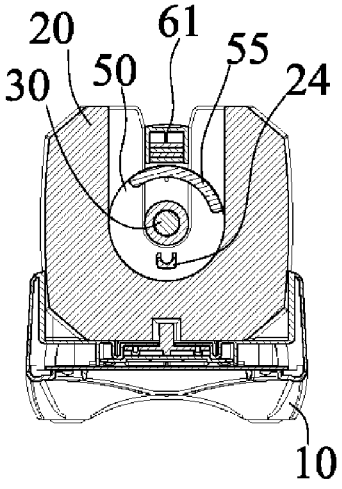
Figure 10B:
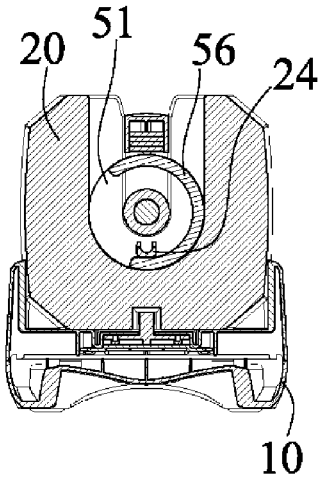
Figure 10C:
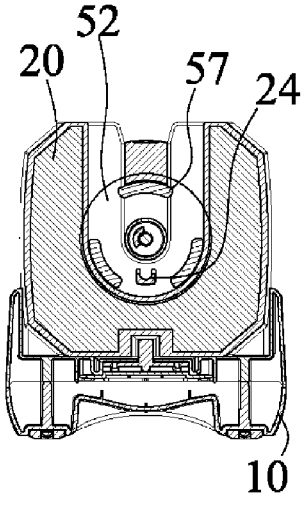
Figure 10:
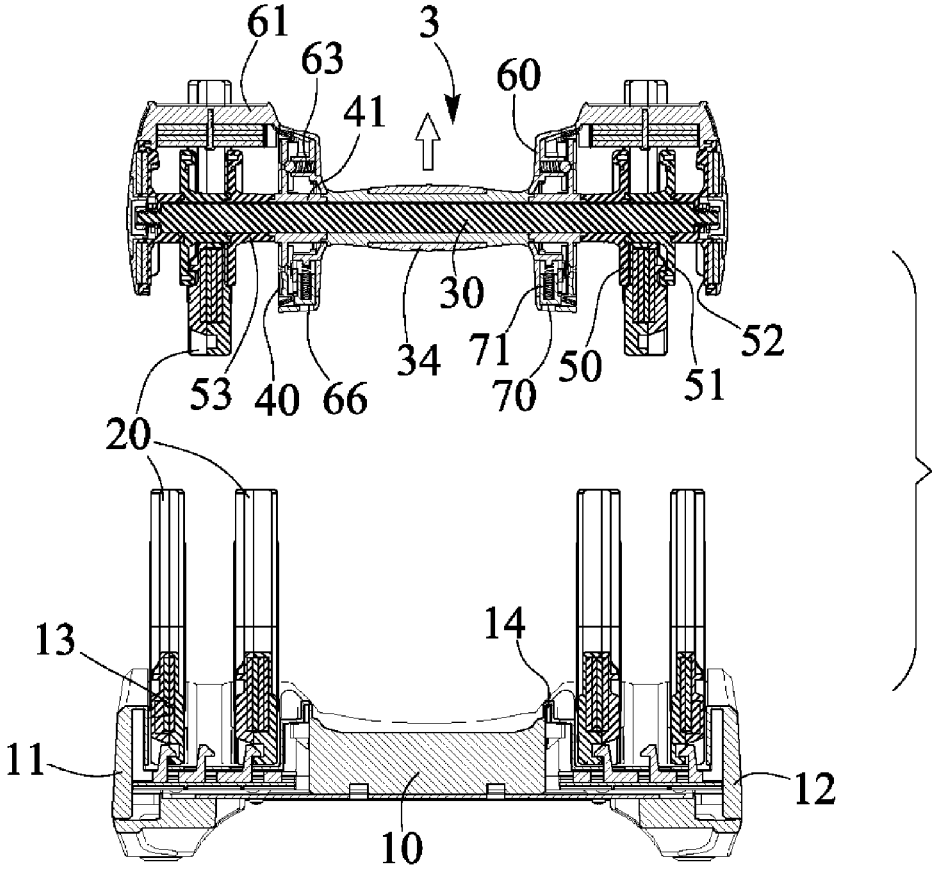
Figures 11A, 11B, 11C:
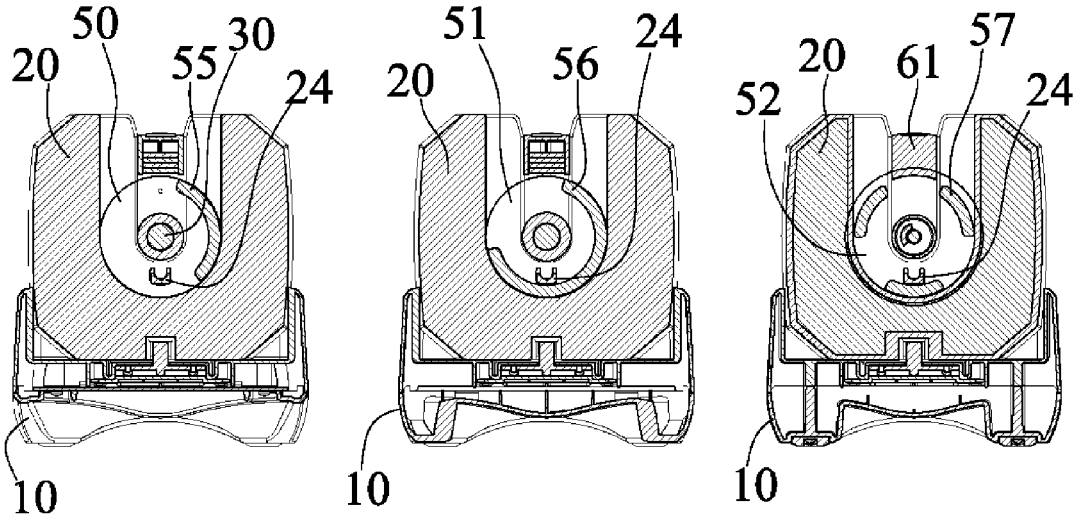
Figure 11:
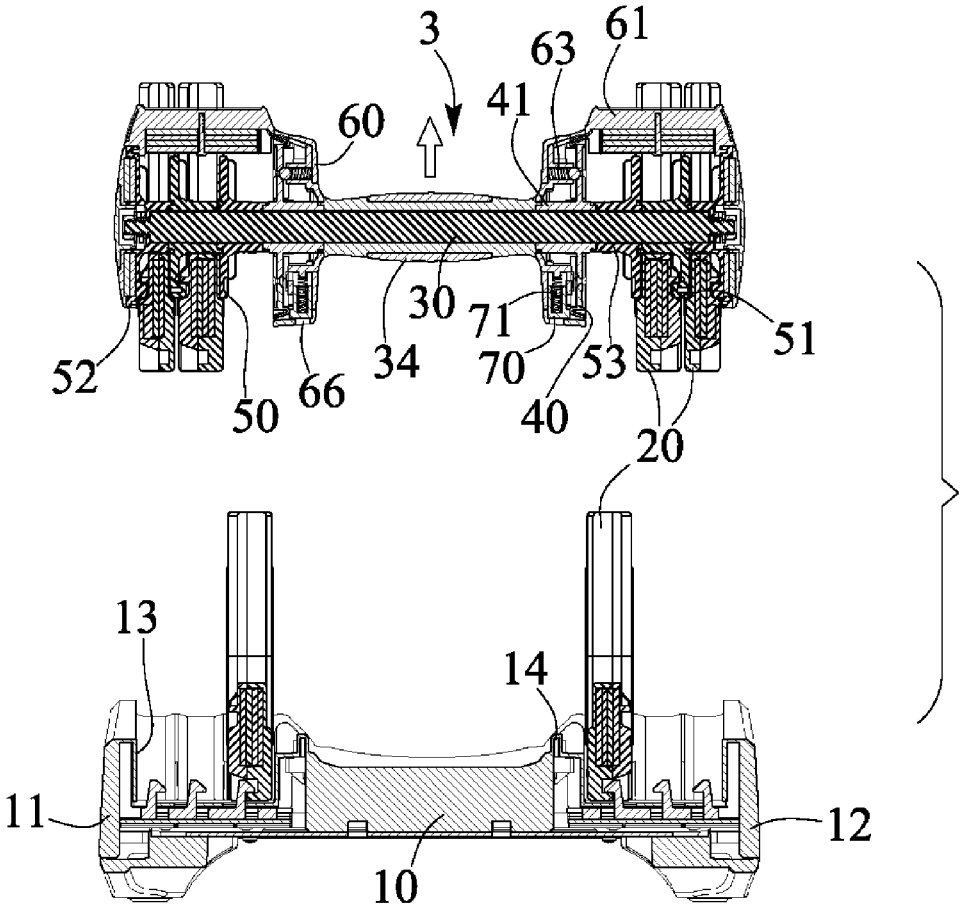
Figure 12A:
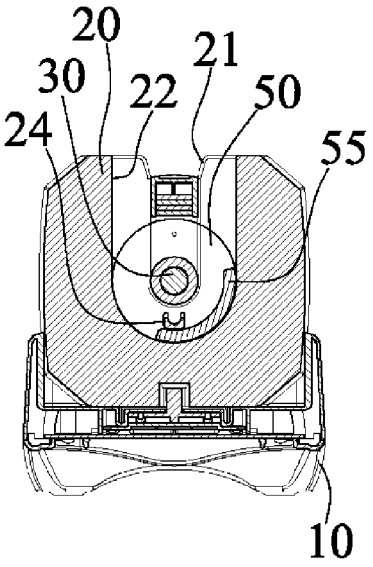
Figure 12B:
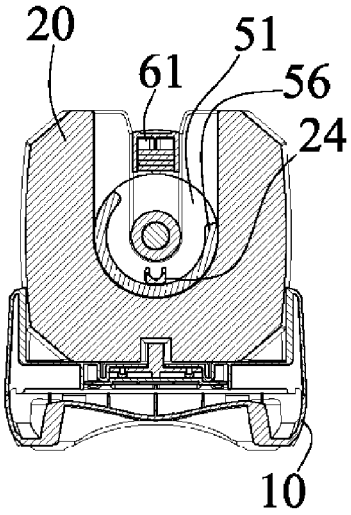
Figure 12C:
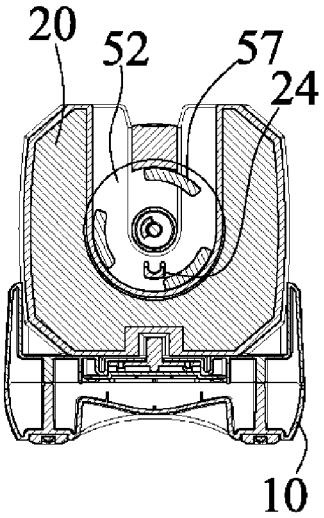
Figure 12:
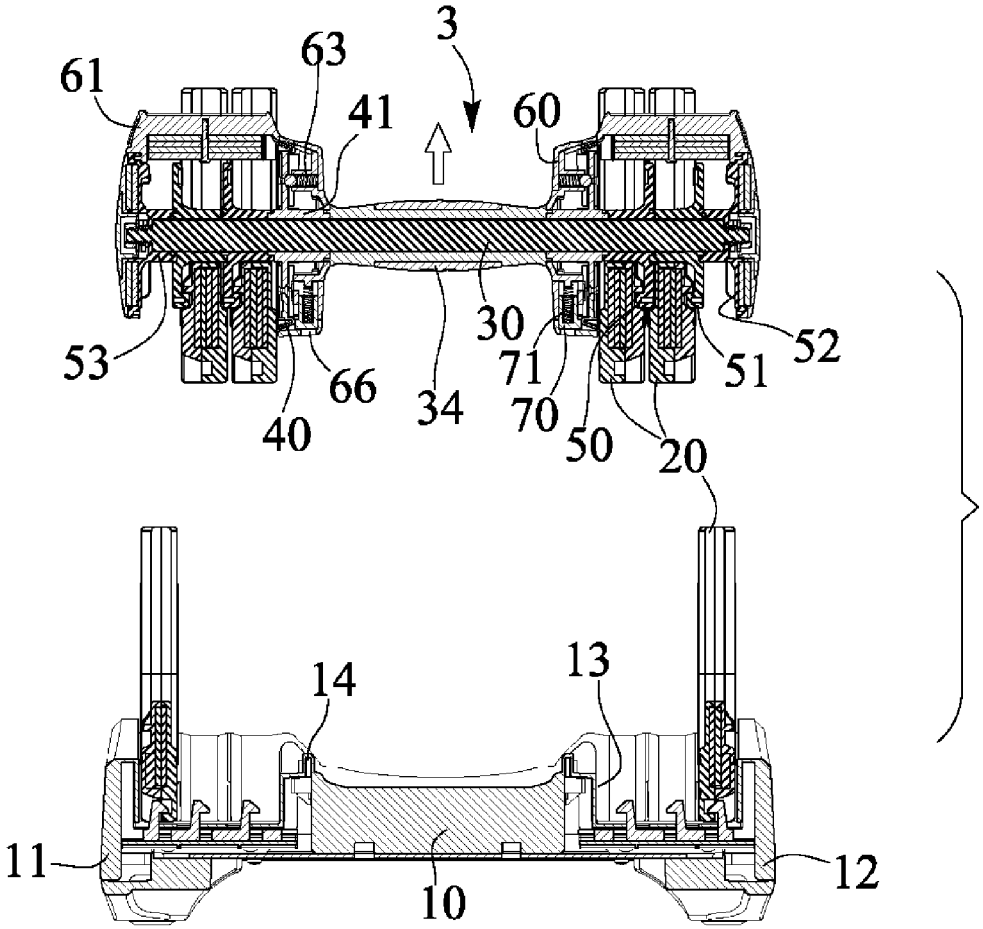

For example, as shown in FIGS. 8A, 8B, 8C; 9A, 9B, 9C; 10A, 10B, 10C; 11A, 11B, 11C; 12A, 12B, 12C; and 13-15, the first plate 50 includes a single engaging element 55 which extends or which includes a length of about one third of the outer peripheral portion of the first plate 50, and the second plate 51 also includes a single engaging element 56 which extends or which includes a length of about two thirds of the outer peripheral portion of the second plate 51, and the third plate 52 includes three equally spaced engaging elements 57 each of which include a length of about one sixth of the outer peripheral portion of the third plate 52 for selectively engaging with the tongues 24 of the weight members 20 respectively when the followers 40 and the plates 50, 51, 52 are rotated relative to the handle bar 30 with the hand grip 34, and for selectively anchoring or latching or retaining the selected numbers of the weight members 20 to the handle bar 30 of the handle device 3 with the plates 50, 51, 52 (FIGS. 5 and 8-12).

In operation, as shown in FIGS. 1-12, the end portions 32, 33 of the handle bar 30 and the barrels 53 of the plates 50-52 may be engaged into the grooves 21 of the weight members 20 for allowing the weight members 20 to be engaged between the plates 50-52 and the followers 40. As shown in FIGS. 3, 5, 8-15, 8A-C; 9A-C; 10A-C; 11A-C and 12A-C, the followers 40 and the plates 50-52 may be rotated relative to the handle bar 30 with the hand grip 34 for selectively engaging the engaging elements 55-57 with the tongues 24 of the weight members 20 respectively, and for selectively anchoring or latching or retaining the selected numbers of the weight members 20 to the handle bar 30 of the handle device 3 with the plates 50-52 (FIGS. 5 and 8-12) due to the arrangement or the engagement of the engaging elements 55-57 of the plates 50-52 with the tongues 24 of the weight members 20 respectively.

Figure 2:
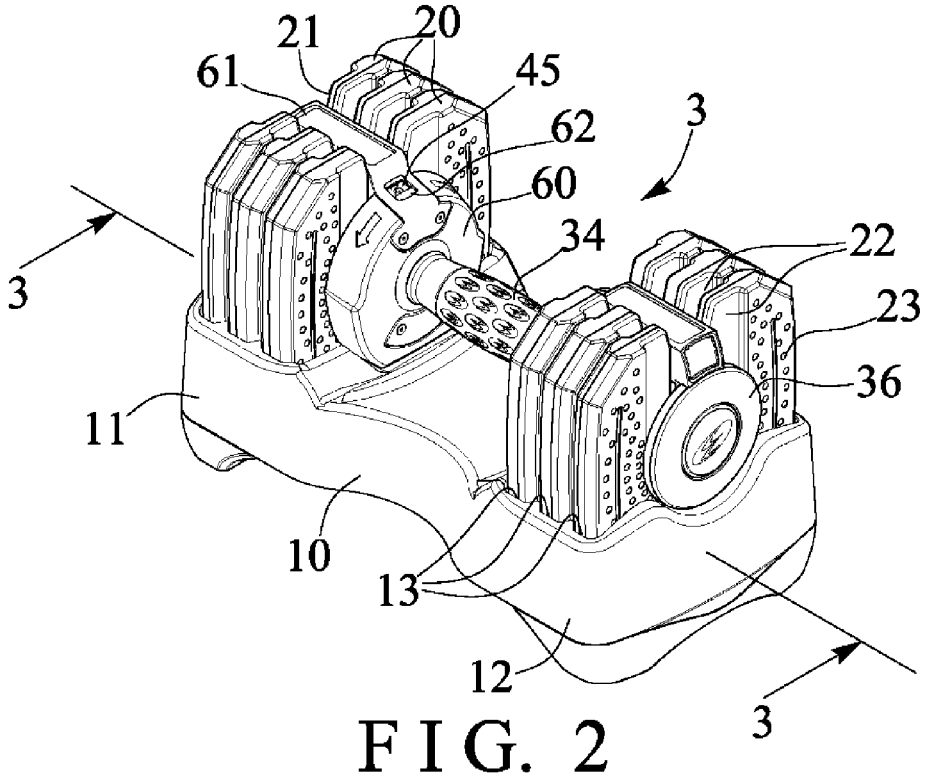
FIG. 2 is a perspective view of the adjustable dumbbell.

The adjustable exercise device or dumbbell further comprises one or more (such as two) control ferrules or housings 60 rotatably disposed or engaged on the handle bar 30 and/or the drums 41 of the followers 40 respectively, and an anchor lever or shank 61 mounted or secured to the respective housing 60 and to be engaged into the grooves 21 of the weight members 20 for anchoring or latching or retaining or positioning the housings 60 to the weight members 20 and for preventing the housings 60 from moving or pivoting or rotating relative to the weight members 30, and the shank 61 includes an opening or window 62 formed and provided therein for selectively aligning with the ears 45 of the followers 40 and for allowing the numeral 46 of the ear 45 of the follower 40 to be seen through the window 62 of the shank 61 of the housing 60 selectively (FIGS. 1, 2). The housings 60 each include an orifice 69 formed therein (FIG. 7) for receiving or engaging with a spring biased projection 63 which is engageable with either of the depressions 47 of the followers 40 and for anchoring or positioning the follower 40 to the housing 60 at the selected angular position.

Figure 4:
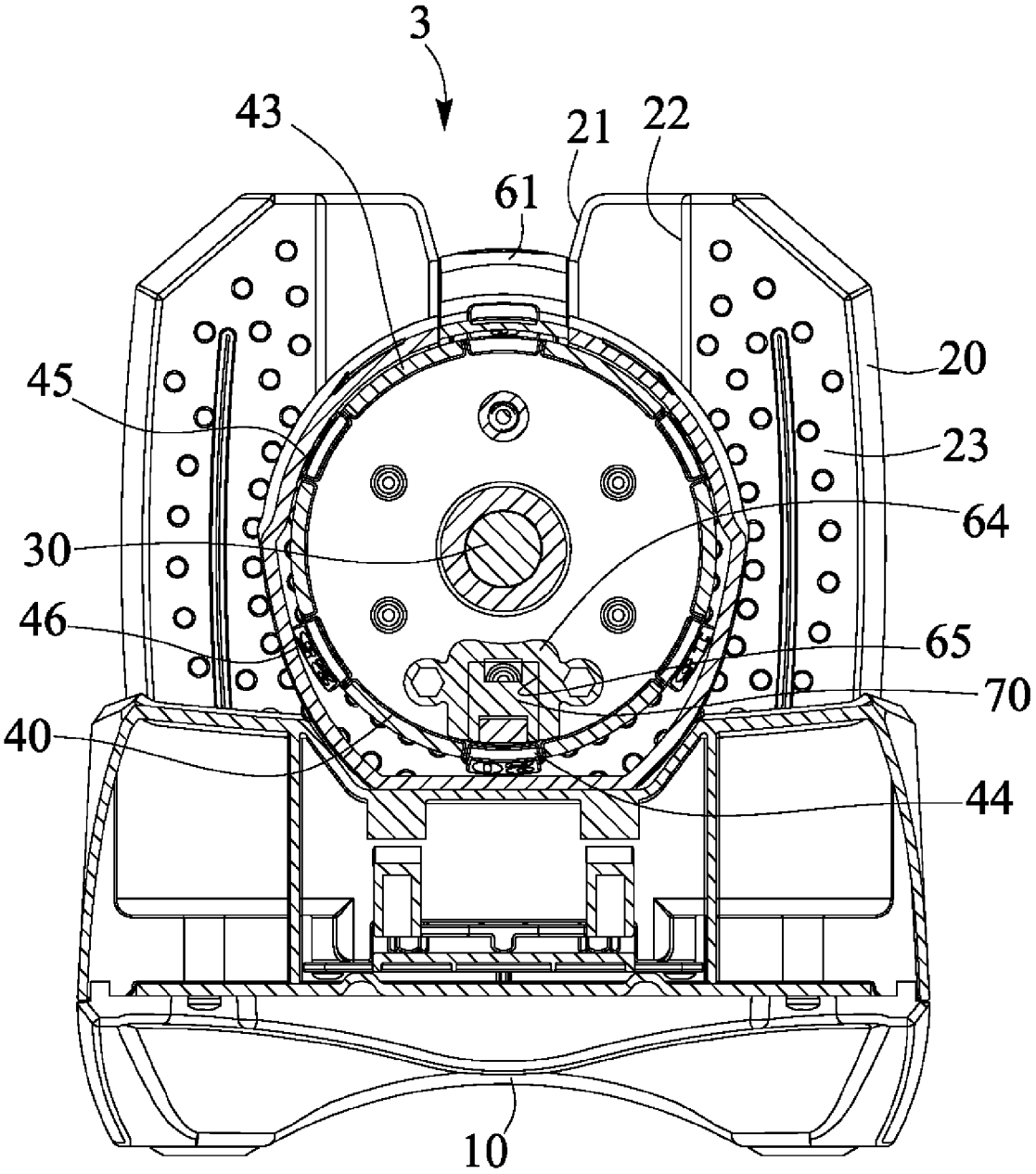
FIG. 4 is another cross sectional view of the adjustable dumbbell, taken along lines 4-4 of FIG. 3.
Figure 6:
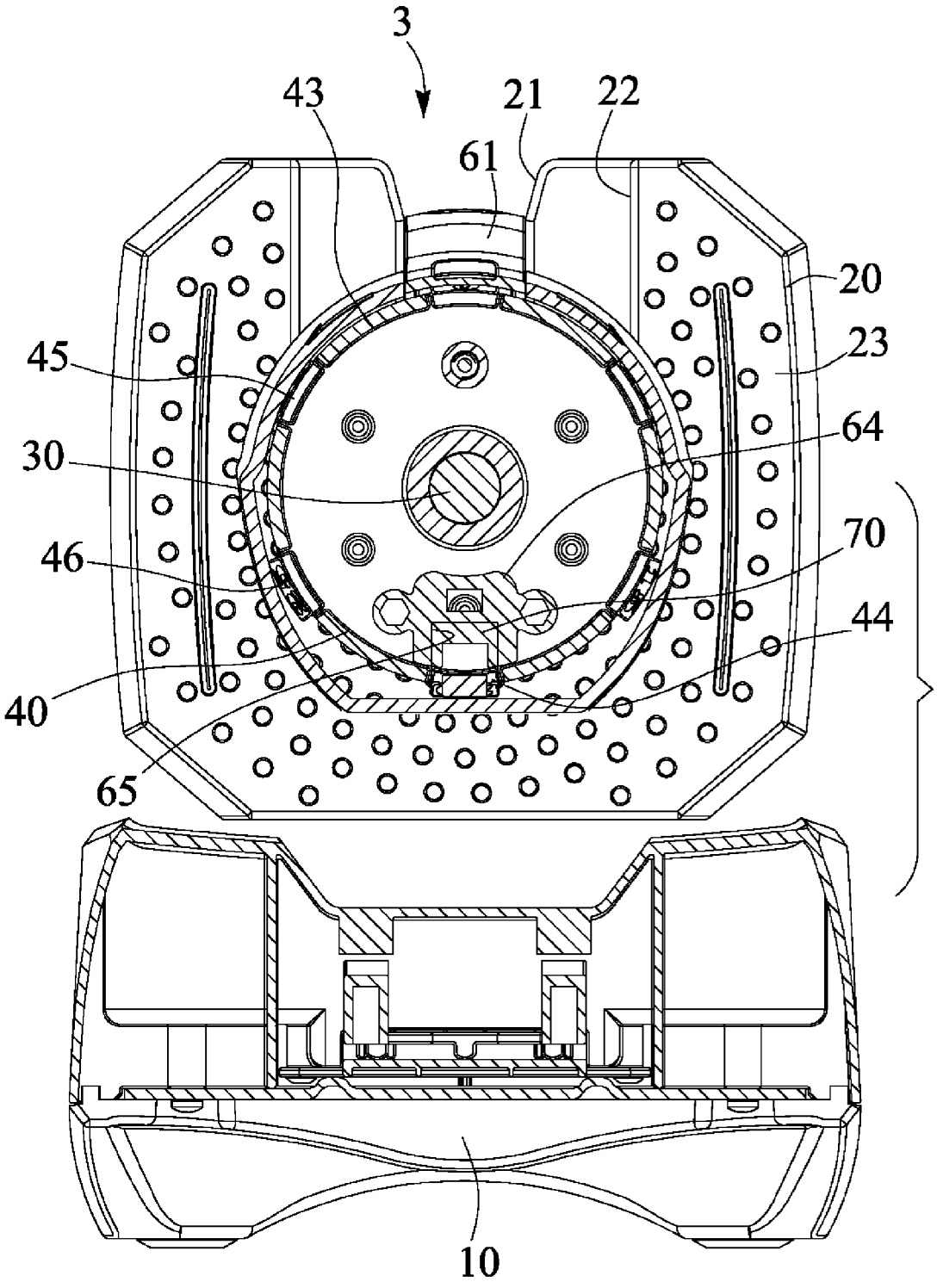
FIG. 6 is a still further cross sectional view of the adjustable dumbbell, taken along lines 6-6 of FIG. 5.

The housings 60 each further include a receptacle or casing 64 formed and provided therein (FIG. 7), and a chamber or compartment 65 formed in the casing 64 for slidably receiving or engaging with a spring biased lock or latch 70 therein, and an orifice 66 formed in a bottom wall 67 of the casing 64 and communicating with the compartment 65 of the casing 64 for selectively receiving or engaging with the key 14 of the base support 10 (FIGS. 3, 4). The casing 64 includes a spring biasing member 71 contacted or engaged with the latch 70 for biasing and forcing or moving the latch 70 to selectively engage with either of the notches 44 of the followers 40 that are formed or provided between the flaps 43 of the follower 40 (FIG. 6) and to prevent the followers 40 and the plates 50-52 and the hand grip 34 from being pivoted or rotated relative to the handle bar 30 and the housings 60, when the followers 40 and the handle device 3 are removed or disengaged or separated from the key 14 of the base support 10 (FIGS. 5, 6).

In operation, as shown in FIGS. 3 and 4, when the handle device 3 and the followers 40 and the plates 50-52 are engaged into the grooves 21 of the weight members 20 that are supported on the base support 10, and when the keys 14 of the base support 10 are engaged into the orifices 66 of the bottom wall 67 of the casing 64 respectively, the keys 14 of the base support 10 may be contacted or engaged with the latch 70 for moving or disengaging or separating the latch 70 from the notches 44 and the flaps 43 of the followers 40 and for allowing the followers 40 and the hand grip 34 of the handle device 3 and the plates 50-52 to be pivoted or rotated relative to the base support 10 and the handle bar 30. At this moment, the keys 14 of the base support 10 are engaged with the orifices 66 of the bottom wall 67 of the casing 64 respectively such that the housings 60 are anchored or positioned or retained to the base support 10 and may not be pivoted or rotated or moved relative to the base support 10 and the handle bar 30.

The followers 40 and the plates 50-52 may thus be easily and quickly rotated relative to the handle bar 30 with the hand grip 34 for selectively engaging with the weight members 20 and for selectively anchoring or latching or retaining the selected numbers of the weight members 20 to the handle bar 30 of the handle device 3 with the plates 50-52 (FIGS. 5 and 8-12). As shown in FIGS. 5 and 6, when the handle device 3 and the followers 40 and the plates 50-52 are removed or disengaged or separated from the base support 10 and the weight members 20, and when the keys 14 of the base support 10 are removed or disengaged or separated from the orifices 66 of the bottom wall 67 of the casing 64 of the housing 60, the latch 70 may be biased and forced and moved to engage with either of the notches 44 of the followers 40 that are formed or provided between the flaps 43 of the follower 40 and to prevent the followers 40 and the plates 50-52 and the hand grip 34 from being pivoted or rotated relative to the handle bar 30 and the housings 60 at this moment. The above structure has been filed in a co-pending patent application.

As shown in FIGS. 16-20, the handle device 3 may further include one or more partitions or spacers 58 disposed and arranged or located between the plates 50, 51 and the follower 40. One of the plates 501 includes a number of bulges or protrusions 59 extended radially and outwardly therefrom. The adjustable dumbbell or barbell or exercise device further includes a detecting device 9 attached or mounted or secured to the handle device 3. For example, one of the shanks 61 of the housing 60 and/or of the handle device 3 includes a compartment or chamber 68 formed therein (FIGS. 17-18, 20) for receiving or accommodating or engaging with the detecting device 9, and includes an aperture 680 formed therein (FIG. 18) and communicating with the chamber 68 of the shank 61 of the housing 60 and/or of the handle device 3.

Figure 18:
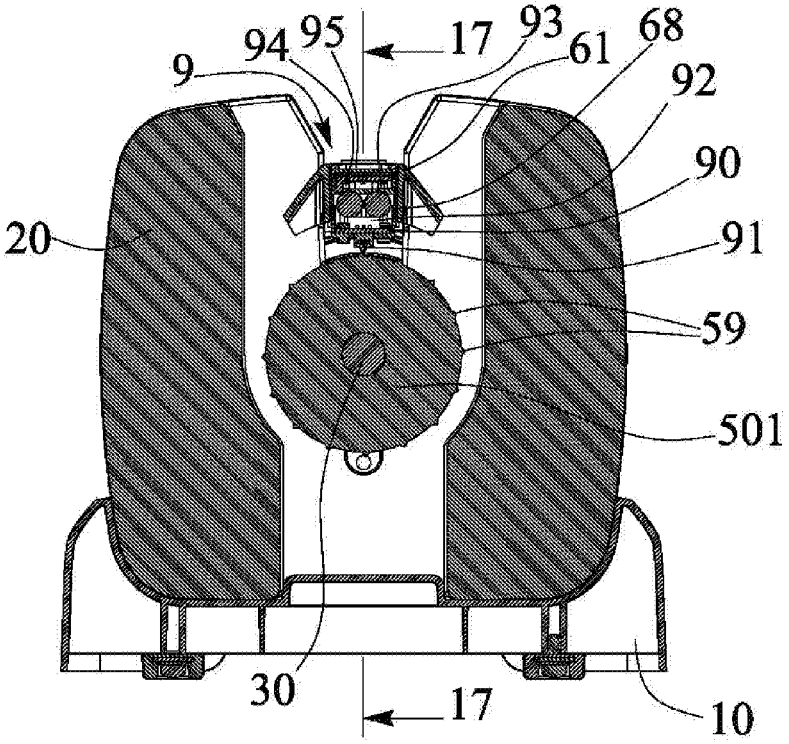
FIG. 18 is a further cross sectional view of the adjustable dumbbell, taken along lines 18-18 of FIG. 17.
Figure 19:
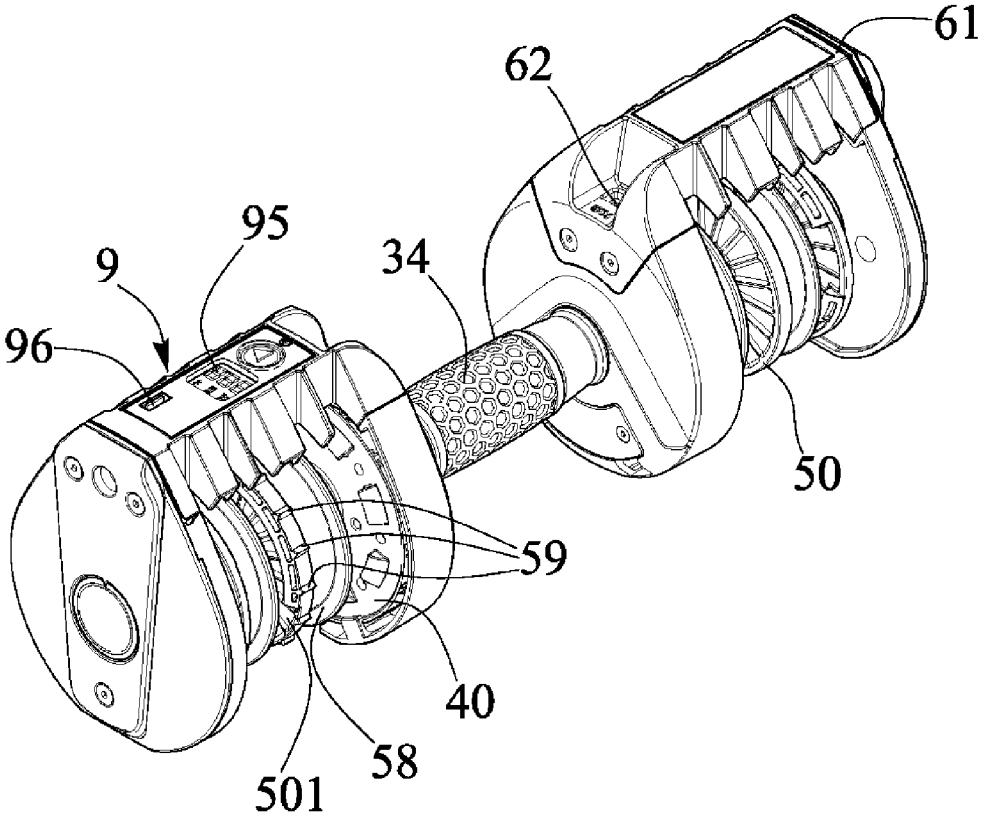
FIG. 19 is another perspective view illustrating a handle device of the adjustable dumbbell.
Figure 20:
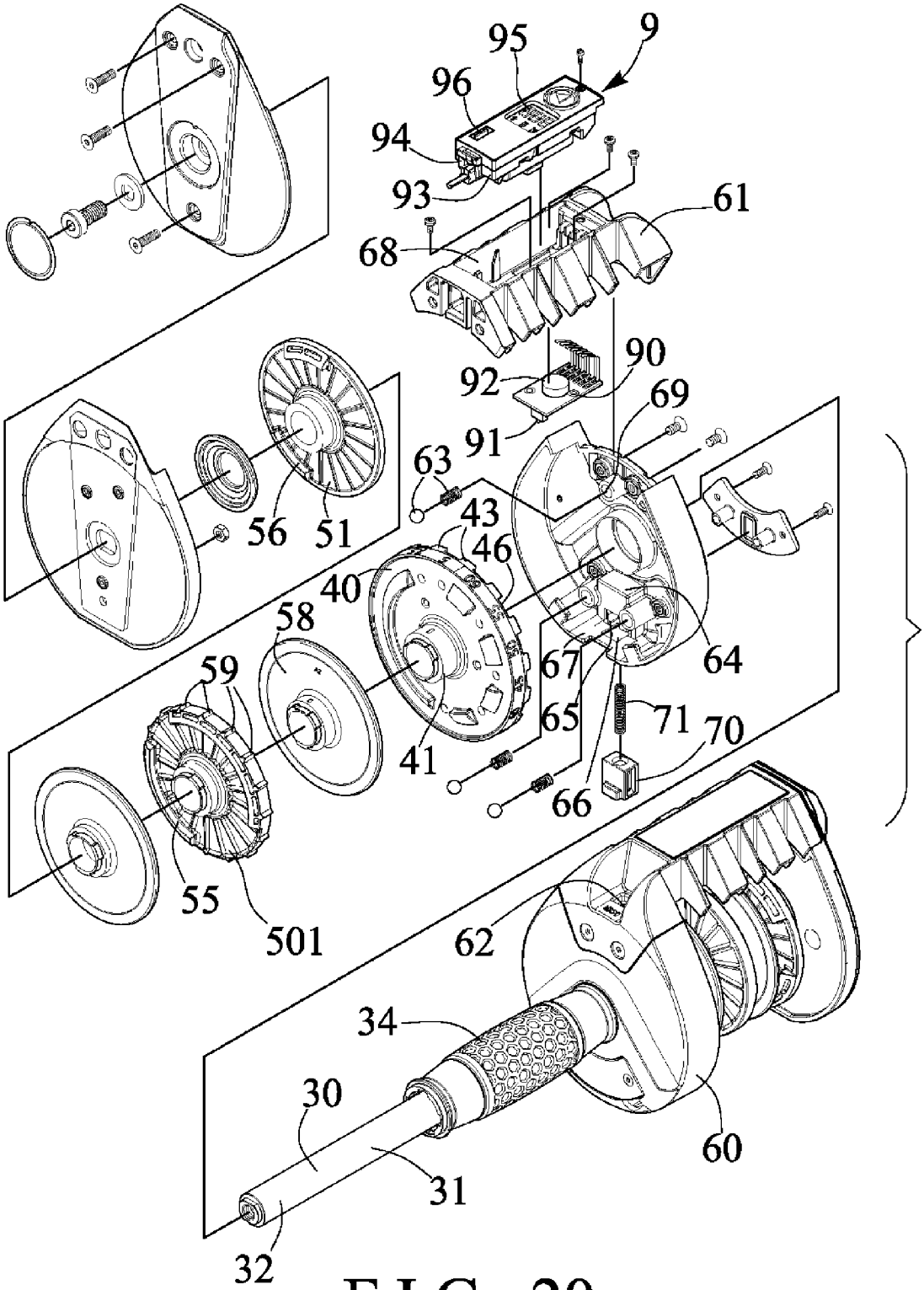
FIG. 20 is a further partial exploded view illustrating the handle device of the adjustable dumbbell.

The detecting device 9 includes a circuit board 90 received or engaged in the chamber 68 of the shank 61 of the housing 60 and/or of the handle device 3, a detecting switch 91 attached or mounted or secured to the circuit board 90 and extended or engaged through the aperture 680 of the shank 61 and faced or directed toward the protrusions 59 of the plate 501, best shown in FIG. 18, for selectively contacting or engaging with the protrusions 59 of the plate 501 and for being switched or actuated or operated by the protrusions 59 of the plate 501. A processor device or central processing unit (CPU) 92 is received or engaged in the chamber 68 of the shank 61 and/or attached or mounted or secured to the circuit board 90 and electrically connected or coupled to the switch 91 for receiving signals from the switch 91.

Figure 21:
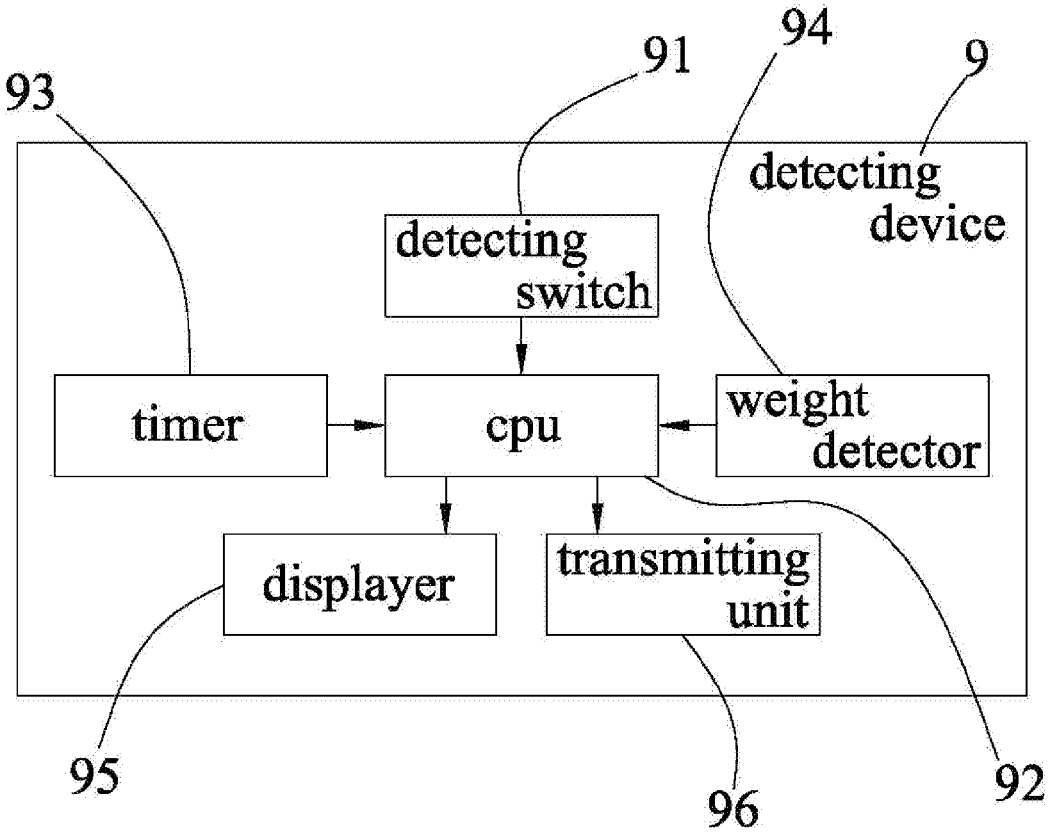
FIG. 21 is a diagram illustrating a detecting device of the adjustable dumbbell.

A timing device or timer 93 and/or a weight detecting device or weight detector 94 are also received or engaged in the chamber 68 of the shank 61 and electrically connected or coupled to the central processing unit 92 for sending timing and/or detecting signals to the central processing unit 92 (FIG. 21). For example, the timer 93 may be used for sensing or detecting the time interval or the time period for how long the adjustable exercise device or dumbbell has been actuated or operated. The weight detector 94 may be used for sensing or detecting the total weight of the handle device 3 and the weight members 20 that have been attached to and carried with the handle device 3 and operated by the user.

A displaying device or displayer 95 and/or a telecommunicating or transmitting device or unit 96 are also received or engaged in the chamber 68 of the shank 61 and electrically connected or coupled to the central processing unit 92 for sending signals into and out of the central processing unit 92 (FIG. 21). The displayer 95 may be used for showing or displaying the time interval or the time period for how long the adjustable exercise device or dumbbell has been actuated or operated, the total weight of the handle device 3 and the weight members 20 that have been attached to and carried with the handle device 3, the calories consumed by the user and calculated with the central processing unit 92, or the like. The transmitting unit 96 may be selected from a universal series bus (USB) interface, Bluetooth, Wireless Fidelity (wifi) etc., and may be used for signal receiving and/or transmitting purposes to and from personal computers (PC), notebooks, iPads, portable phones, etc.

Accordingly, the adjustable exercise device or dumbbell in accordance with the present invention includes an improved compact structure for allowing the weight members to be easily and quickly and readily and adjustably attached to or disengaged from the weight carrier or handle and for allowing the adjustable dumbbell to be easily operated by the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable exercise device comprising:

a plurality of weight members each including a groove formed therein, and said weight members each including a tongue extended laterally therefrom, a handle device including a handle bar having an end portion selectively engageable into said grooves of said weight members, and a hand grip disposed on said handle bar, a plurality of plates rotatably disposed on said handle bar and rotated in concert with said hand grip relative to said handle bar, said plates being selectively engageable between said weight members, and said plates each including an engaging element provided thereon for selectively engaging with said tongues of said weight members respectively when said plates and said hand grip are rotated relative to said handle bar, and for selectively anchoring a selected number of weight members of said plurality of weight members to said handle bar of said handle device with said plates, a first plate of said plates including a plurality of protrusions extended from said first plate, and a detecting device attached to said handle device and including a central processing unit, a weight detector electrically connected to said central processing unit for sending signals to said central processing unit, and a displayer electrically connected to said central processing unit for sending signals to said central processing unit and for displaying a total weight of said handle device and said weight members, said detecting device including a switch electrically connected to said central processing unit for sending signals to said central processing unit, and said protrusions of said first plate being provided for selectively contacting with said switch and for actuating said switch.

2. The adjustable exercise device as claimed in claim 1, wherein said handle device includes a housing and a shank for engaging into said grooves of said weight members and for anchoring said housing to said weight members and for preventing said housing from rotating relative to said weight members, and said shank includes a chamber formed therein for engaging with said detecting device.

3. The adjustable exercise device as claimed in claim 2, wherein said shank includes an aperture formed therein and communicating with said chamber of said shank for engaging with said switch.

4. The adjustable exercise device as claimed in claim 2, wherein said handle device includes a follower disposed between said plates and said hand grip and rotated in concert with said plates and said hand grip relative to said handle bar, said follower includes a plurality of flaps extended therefrom and spaced from each other for forming a plurality of notches between said flaps, said shank includes a window formed in said shank, and said follower includes a plurality of ears for selectively aligning with said window of said shank, and said ears each include a numeral for being shown through said window of said shank.

5. The adjustable exercise device as claimed in claim 4, wherein said housing is rotatably engaged on said handle bar, and said housing includes a spring biased latch for selectively engaging with any one of said notches of said follower and for preventing said follower from being rotated relative to said housing, and said housing includes a casing having a compartment formed in said casing for slidably engaging with said spring biased latch.

6. The adjustable exercise device as claimed in claim 5, wherein said housing includes a spring biased projection engageable with said follower for anchoring and positioning said follower to said housing at selected angular positions, and said follower includes a plurality of depressions formed therein for selectively engaging with said spring biased projection.

7. The adjustable exercise device as claimed in claim 1, wherein said detecting device includes a timer electrically connected to said central processing unit for sensing and sending a timing signal to said central processing unit.

8. The adjustable exercise device as claimed in claim 1, wherein said detecting device includes a transmitting unit electrically connected to said central processing unit for sending signals to said central processing unit.

* * * * *